US009534876B2

(12) United States Patent
Silvers

(10) Patent No.: US 9,534,876 B2
(45) Date of Patent: Jan. 3, 2017

(54) PROJECTILE AND MOLD TO CAST PROJECTILE

(71) Applicant: RA BRANDS, L.L.C., Madison, NC (US)

(72) Inventor: Robert Silvers, Mansfield, MA (US)

(73) Assignee: RA Brands, L.L.C., Madison, NC (US)

( * ) Notice: Subject to any disclaimer, the term of this patent is extended or adjusted under 35 U.S.C. 154(b) by 19 days.

(21) Appl. No.: 14/289,354

(22) Filed: May 28, 2014

(65) Prior Publication Data

US 2015/0226531 A1 Aug. 13, 2015

Related U.S. Application Data

(60) Provisional application No. 61/855,936, filed on May 28, 2013.

(51) Int. Cl.
*F42B 14/02* (2006.01)
*F42B 5/28* (2006.01)
(Continued)

(52) U.S. Cl.
CPC . *F42B 5/28* (2013.01); *B22C 9/06* (2013.01); *B22C 9/22* (2013.01); *F41A 9/70* (2013.01);
(Continued)

(58) Field of Classification Search
CPC ..... F42B 14/02; F42B 12/00; F42B 12/72; F42B 12/74; F42B 12/745; F42B 12/76; F42B 12/78; F42B 33/001; F42B 12/02; F42B 5/067; F42B 5/28; F41A 9/70; B22C 9/22; B22C 9/06
(Continued)

(56) References Cited

U.S. PATENT DOCUMENTS 1,012,455 A * 12/1911 Scott ..... F42B 12/78 102/514
1,081,616 A 12/1913 Johnson
(Continued)

FOREIGN PATENT DOCUMENTS

DE 648039 C 7/1937
DE 705504 C 4/1941
(Continued)

OTHER PUBLICATIONS

International Search Report dated Oct. 7, 2014 for PCT/US2014/015672 filed Feb. 11, 2014.
(Continued)

*Primary Examiner* — John D Cooper
(74) *Attorney, Agent, or Firm* — Womble Carlyle Sandridge & Rice LLP

(57) ABSTRACT

This disclosure relates generally to a bullet having a first or proximal end, a second or distal end, and a curved circumferential feature formed between the proximal and distal ends of the bullet. The proximal end comprises a large meplat and a circumferential guidance feature. The circumferential guidance feature is configured to be operable with the rib of an ammunition magazine to help prevent binding and allow for normal alignment in the ammunition magazine. As a result, the bullet has more stability within the ammunition magazine, higher potential accuracy, and ability to have longer and heavier projectiles. The bullet further can be cast in a mold to form the bullet with the desired shape, including the circumferential guidance feature formed therein.

20 Claims, 15 Drawing Sheets

(51) Int. Cl.

| | |
|---|---|
| ***F42B 33/00*** | (2006.01) |
| ***B22C 9/06*** | (2006.01) |
| ***B22C 9/22*** | (2006.01) |
| ***F42B 5/067*** | (2006.01) |
| ***F42B 12/02*** | (2006.01) |
| ***F41A 9/70*** | (2006.01) |

(52) U.S. Cl.
CPC ..... *F42B 5/067* (2013.01); *F42B 12/02* (2013.01); *F42B 33/00* (2013.01); *F42B 33/001* (2013.01); *F42B 14/02* (2013.01)

(58) Field of Classification Search
USPC ..... 102/439, 503, 506, 508–512, 514–519,102/524, 526; 86/39, 54; D22/115
See application file for complete search history.

(56) References Cited

U.S. PATENT DOCUMENTS 1,107,948 A * 8/1914 Hoagland ..... F42B 12/34 102/507
1,681,295 A 8/1928 Johnson
1,767,308 A * 6/1930 Phillips ..... F42B 12/78 102/507
1,892,158 A 12/1932 Matthews
2,045,964 A 6/1936 Rinkel
2,103,155 A * 12/1937 Foulke ..... F42B 14/06 102/526
2,322,751 A 6/1943 Studler
2,333,091 A * 11/1943 Crasnoff ..... F42B 12/34 102/507
2,696,130 A 12/1954 Peters
2,759,421 A * 8/1956 Sublette ..... F42B 14/02 102/526
3,142,256 A 7/1964 Mack
3,143,966 A 8/1964 Burns, Jr. et al.
3,157,137 A 11/1964 Burns, Jr.
3,159,701 A 12/1964 Herter
3,169,333 A 2/1965 Scanlon, Jr.
3,186,058 A 6/1965 Mittelsteadt
3,234,877 A 2/1966 Herter
3,279,375 A 10/1966 Herter
3,311,962 A 4/1967 Burns, Jr.
3,349,711 A 10/1967 Darigo et al.
3,359,906 A 12/1967 Herter
3,368,489 A 2/1968 Herter
3,370,534 A 2/1968 Herter
3,412,681 A 11/1968 Schirneker
3,590,740 A 7/1971 Herter
3,591,898 A 7/1971 Stenmo
3,614,929 A 10/1971 Herter et al.
3,673,965 A 7/1972 Herter
3,678,858 A 7/1972 Herter et al.
3,727,557 A 4/1973 Starcevich
3,752,434 A 8/1973 Herter
3,808,974 A 5/1974 Herter
3,812,784 A 5/1974 Herter
3,835,783 A 9/1974 Curran
3,881,421 A 5/1975 Burczynski
3,890,902 A * 6/1975 Travor ..... F42B 14/064 102/518
3,913,489 A * 10/1975 Travor ..... F42B 14/064 102/526
3,974,775 A 8/1976 Kerzman et al.
4,044,679 A 8/1977 Pagano et al.
4,108,073 A 8/1978 Davis
4,336,756 A 6/1982 Schreiber
4,352,225 A 10/1982 Schreiber
4,517,897 A 5/1985 Kneubuhl
4,550,662 A 11/1985 Burczynski
4,660,263 A 4/1987 Kosteck
4,776,279 A 10/1988 Pejsa
4,793,037 A 12/1988 Carter
4,856,160 A 8/1989 Habbe et al.
4,870,884 A 10/1989 Schubart et al.
4,878,434 A 11/1989 Sommet
4,947,755 A 8/1990 Burczynski
5,160,805 A 11/1992 Winter
5,357,866 A 10/1994 Schluckebier et al.
5,385,100 A 1/1995 Corzine et al.
5,385,101 A 1/1995 Corzine et al.
5,452,535 A 9/1995 See et al.
5,535,495 A * 7/1996 Gutowski ..... B22D 17/00 86/54
5,644,100 A 7/1997 Puckett et al.
5,686,693 A * 11/1997 Jakobsson ..... F42B 14/02 102/501
D389,221 S * 1/1998 Borg ..... D22/115
5,943,749 A 8/1999 Swank
6,119,600 A 9/2000 Burri
6,138,395 A 10/2000 ODwyer
6,164,209 A 12/2000 Best et al.
6,213,022 B1 4/2001 Pullum
6,244,187 B1 6/2001 Head
6,260,484 B1 7/2001 Billings
D447,209 S 8/2001 Benini
D456,480 S * 4/2002 Quinsa ..... 102/508
6,510,643 B2 * 1/2003 O'Dwyer ..... F41A 25/12 102/521
6,530,328 B2 3/2003 Burczynski et al.
6,600,126 B2 7/2003 Steinhoff et al.
6,776,101 B1 8/2004 Pickard
6,805,057 B2 10/2004 Carr et al.
7,143,679 B2 12/2006 Yaich
7,171,904 B2 2/2007 Diller
7,174,833 B2 2/2007 Diller
7,210,411 B2 5/2007 Booth et al.
7,210,412 B2 5/2007 ODwyer
7,322,297 B2 1/2008 Yaich
7,380,502 B2 6/2008 Emary
7,415,929 B1 8/2008 Faughn
7,464,649 B2 12/2008 Bishop et al.
7,475,635 B2 1/2009 Bambach
7,475,636 B2 1/2009 ODwyer et al.
7,503,260 B2 3/2009 Kapeles
7,707,941 B2 5/2010 Bishop et al.
7,707,942 B1 5/2010 Gardner
7,748,325 B2 7/2010 Marx
D621,468 S 8/2010 Nilsson
7,854,083 B1 12/2010 Aalto
7,874,253 B2 1/2011 Marx
7,891,298 B2 2/2011 Minick et al.
7,908,780 B2 3/2011 Fitzpatrick et al.
7,984,675 B2 7/2011 ODwyer
D646,179 S 10/2011 Jansen
8,042,297 B2 * 10/2011 Emde ..... F41A 9/69 42/49.01
8,061,255 B1 * 11/2011 Boberg ..... F41A 9/23 42/16
8,109,212 B2 2/2012 ODwyer
8,117,967 B2 2/2012 Salvel
8,161,885 B1 4/2012 Emary
8,171,852 B1 5/2012 Rebar
8,186,277 B1 5/2012 King
D664,042 S 7/2012 Kurpis
8,220,393 B2 7/2012 Schluckebier et al.
8,256,352 B2 9/2012 Masinelli
8,307,768 B2 11/2012 Cziglenyi
8,397,641 B1 3/2013 Jackson
8,418,620 B2 4/2013 Frank
8,448,575 B2 5/2013 Goddard
8,511,233 B2 8/2013 Nilsson
8,640,589 B2 2/2014 Dryer et al.
8,646,389 B2 2/2014 Masinelli
8,752,484 B2 6/2014 Burczynski
8,763,535 B2 7/2014 Padgett
8,789,470 B2 7/2014 Frank
8,950,333 B2 2/2015 Burczynski et al.
2005/0183617 A1 8/2005 MacDougall
2006/0027128 A1 2/2006 Hober
2006/0027132 A1 * 2/2006 Libra ..... F42B 12/34 102/522

(56) References Cited

U.S. PATENT DOCUMENTS

| | | | | |
|---|---|---|---|---|
| 2007/0204758 | A1 | 9/2007 | Spatz et al. | |
| 2009/0241796 | A1 | 10/2009 | Bambach | |
| 2009/0288572 | A1 | 11/2009 | Sauvestre | |
| 2010/0224093 | A1 | 9/2010 | Wilhelm et al. | |
| 2010/0263565 | A1 | 10/2010 | Hugus et al. | |
| 2011/0088537 | A1 | 4/2011 | Eberhart | |
| 2011/0179965 | A1 | 7/2011 | Mason | |
| 2011/0252997 | A1 | 10/2011 | Hoffman | |
| 2012/0124879 | A1 | 5/2012 | Larue | |
| 2012/0227615 | A1 | 9/2012 | Beal | |
| 2012/0234198 | A1 | 9/2012 | Carmel | |
| 2013/0014664 | A1 | 1/2013 | Padgett | |
| 2013/0014668 | A1 | 1/2013 | Emary | |
| 2013/0025490 | A1 | 1/2013 | Burczynski | |
| 2013/0055917 | A1 | 3/2013 | Menefee | |
| 2013/0086834 | A1 | 4/2013 | Battaglia | |
| 2013/0305950 | A1 | 11/2013 | Coffman, II | |
| 2014/0261044 | A1 | 9/2014 | Seecamp | |
| 2014/0311372 | A1 | 10/2014 | Burczynski et al. | |
| 2014/0331885 | A1 | 11/2014 | Burczynski | |
| 2015/0354930 | A1* | 12/2015 | Fricke | F42B 12/34 102/439 |
| 2016/0025469 | A1* | 1/2016 | Nurminen | F42B 12/34 102/508 |

FOREIGN PATENT DOCUMENTS

| | | | |
|---|---|---|---|
| DE | 743914 | C | 1/1944 |
| DE | 1072515 | | 12/1959 |
| DE | 2064553 | A1 | 7/1972 |
| DE | 3834925 | A1 | 4/1990 |
| EP | 0225532 | A1 | 7/1987 |
| EP | 0918208 | A1 | 5/1999 |
| GB | 191300326 | A | 1/1914 |
| WO | WO 2013/016330 | | 1/2013 |
| WO | WO 2014/116950 | | 7/2014 |
| WO | WO 2014/186007 | | 11/2014 |

OTHER PUBLICATIONS

Written Opinion dated Oct. 7, 2014 for PCT/US2014/015672 filed Feb. 11, 2014.
Photograph of Herters 22 Caliber Jacketed Bullets.
"Multiple Projectile Technology", http://www.lehighdefense.com/index.php/our-technology/multiple-projectile-technology (accessed Feb. 11, 2013).
Managed-Recoil Rifle Cartridges; Remington 2008 Catalog: Firearms, Ammunition & Accessories; Remington Arms Company, Inc., Madison, North Carolina; p. 70.
Pistol & Revolver Cartridges; Remington 2008 Catalog: Firearms, Ammunition & Accessories; Remington Arms Company, Inc., Madison, North Carolina; p. 72.
Premier Accutip: Precisely the Big-Game Bullet of Your Dreams; Remington 2008 Catalog: Firearms, Ammunition & Accessories; Remington Arms Company, Inc., Madison, North Carolin.
Premier Core-Lokt Ultra Bonded: The New Standard of Accuracy in Bonded Hunting Bullets; Remington 2008 Catalog: Firearms, Ammunition & Accessories; Remington Arms Company, Inc.
Remington Core-Lokt: The Worlds Best-Selling Centerfire Ammunition; Remington 2008 Catalog: Firearms, Ammunition & Accessories; Remington Arms Company, Inc., Madison, North C.
Remington Reloading Components; Remington 2008 Catalog: Firearms, Ammunition & Accessories; Remington Arms Company, Inc., Madison, North Carolina; p. 75.
Remington Rifle Cartridges; Remington 2008 Catalog: Firearms, Ammunition & Accessories; Remington Arms Company, Inc., Madison, North Carolina; p. 68.
Don Roberts, At Last! Pressure Data for the .30-40 Krag, Handloader: The Journal of Ammunition Reloading, Jul.-Aug. 1976, pages cover, 4, 38-41, issue 62, Wolfe Publishing.
George C. Lambert, letter to Mr. C. V. Bracher regarding "Belted Bullet", Mar. 4, 1936, 1 pages, Peters Cartridge Division of Remington Arms Co., Inc., Bridgeport, CT.
International Search Report dated Apr. 17, 2014 for International Application No. PCT/US2014/012952 filed Jan. 24, 2014.
International Search Report for PCT/US2012/047966 dated Oct. 16, 2012.
Maj. George Nonte, Tip to Tip, Handloader: The Journal of Ammunition Reloading, Jul.-Aug. 1976, pages cover, 4, 12-13, Issue 62, Wolfe Publishing Company, Inc., Prescott, Arizona 86301.
Photograph of .30 U.S. Govt. 1906-180 GRA . . . ; Scientific Bullet Design Ins . . . Superfine Accuracy; and Heavy Jacket Re-Inforced by Belt.
Sharpe, Philp Burdette, "Complete Guide to Handloading", pp. 41-43, third edition, Wolfe Pub Co.; 1988.
Written Opinion dated Apr. 17, 2014 for International Application No. PCT/US2014/012952 filed Jan. 24, 2014.
Written Opinion for PCT/US2012/047966 dated Oct. 16, 2012.
"Federals Flightcontrol Wads"; www.wildfowlmag.com; http://www.wildfowlmag.com/tips_strategies_wf_smartwads_1209.html (Accessed Dec. 12, 2013).
"Flitecontrol shotgun wadding for Federal tactical 00 buckshot 9-pellet"; www.weaponscache.com; http://www.weaponscache.com/forum/ammunition-reloading/6401-flitecontrol-shotgun-wadding-federal-tactical-00-buckshot-9-pellet.html.
"Great Gun/Load Combo for Gobblers"; www.shootingtimes.com; hppt://www.shootingtimes.com/2011/01/03/longgun_reviews_benellis_082907/ (Accessed Dec. 12, 2013).
"Questions about Federal LE23200"; www.shotgunworld.com; http://www.shotgunworld.com/bbs/viewtopic.php?f+7&t=213155 (Accessed Dec. 12, 2013).
"Winchester Wads"; www.winchester.com; http://www.winchester.com/products/components/wads-shot/winchester-wads/Pages/winchester-wads.aspx (Accessed Dec. 12, 2013).

* cited by examiner

PROJECTILE AND MOLD TO CAST PROJECTILE

CROSS REFERENCE TO RELATED APPLICATIONS

The present Patent Application is a formalization of previously filed, U.S. Provisional Patent Application Ser. No. 61/855,936, filed May 28, 2013 by the inventors named in the present Application. This Patent Application claims the benefit of the filing date of the cited Provisional Patent Application according to the statutes and rules governing provisional patent applications, particularly 35 U.S.C. §119 (a)(i) and 37 C.F.R. §1.78(a)(4) and (a)(5). The specification and drawings of the Provisional Patent Application referenced above are specifically incorporated herein by reference as if set forth in their entirety.

FIELD OF DISCLOSURE

This disclosure relates generally to ammunition, and more specifically, to projectiles having a circumferential guidance feature adapted to receive and engage a rib of an ammunition magazine in which the ammunition is loaded to prevent binding of the ammunition as it is moved along and fed from the magazine.

BACKGROUND OF INVENTION

To ensure proper function and operation of a firearm, it is desirable and necessary to ensure feeding of cartridges from a magazine into the firearm chamber as smoothly and as quickly as possible as the cartridges are advanced along the magazine. Some common 5.56 mm M4/AR-platform magazines have a rib designed to rest on the case neck of standard 223 and 5.56 mm ammunition. However, when larger caliber ammunition, such as 300 AAC Blackout and 300 Whisper® cartridges are fed from such magazines, the magazine rib frequently rests on a part of the bullet which is 0.308 diameter, rather than the 5.56 mm case neck, which is 0.253 diameter. This forces the cartridges to tilt inward, often causing binding of the rounds if the magazine is loaded past approximately 10 rounds. This binding can cause problems with consistent and arcuate feeding of the rounds from the magazine as the spring within the magazine quickly pushes or urges the next cartridge to the top of the stack. As a result, the rounds can become jammed in the magazine and/or otherwise may not feed properly therefrom. The prior-art solution generally has been to load the cartridges to a shorter-than-optimal overall length or limit use to pointed projectiles with a large radius ogive, often precluding the use of projectiles with a large meplat (flat front).

SUMMARY OF DISCLOSURE

In one embodiment, the present disclosure generally relates to a bullet comprising a first or proximal end, a second or distal end, and a circumferential guidance feature formed between the proximal and distal ends of the bullet. The proximal end of the bullet can be formed with a meplat that can have a substantially flattened front surface of an increased size, with the circumferential guidance feature spaced therefrom. The first diameter can be larger than the second diameter, and, the circumferential guidance feature further can gradually reduce and connect the proximal end with the first diameter and the distal end with the second diameter. The circumferential guidance feature generally will be configured to be operable with the rib of an ammunition magazine to help prevent binding and allow for normal, optimal alignment of the bullet within the ammunition magazine. As a result, the bullet is able to be seated within and fed from the ammunition magazine in a consistent manner.

The present disclosure further relates to a method of making a bullet by casting the bullet with a first or proximal end, a second or distal end, and a circumferential guidance feature formed between the proximal and distal ends of the bullet. The proximal end can be formed with an extended ogive portion that tapers toward a meplat, which can be of an expanded or increased diameter. The circumferential guidance feature is formed by casting the bullet within a mold or by similarly forming or molding the bullet shape. In such a method, the bullet can be formed from a metal or metal alloy that is poured or pressed into the mold.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the invention, are incorporated in and constitute a part of this specification, illustrate embodiments of the invention, and together with the detailed description, serve to explain the principles of the invention. No attempt is made to show structural details of the invention in more detail than may be necessary for a fundamental understanding of the invention and the various ways in which it may be practiced. In the drawings.

DETAILED DESCRIPTION OF THE DISCLOSURE

Figure 1:
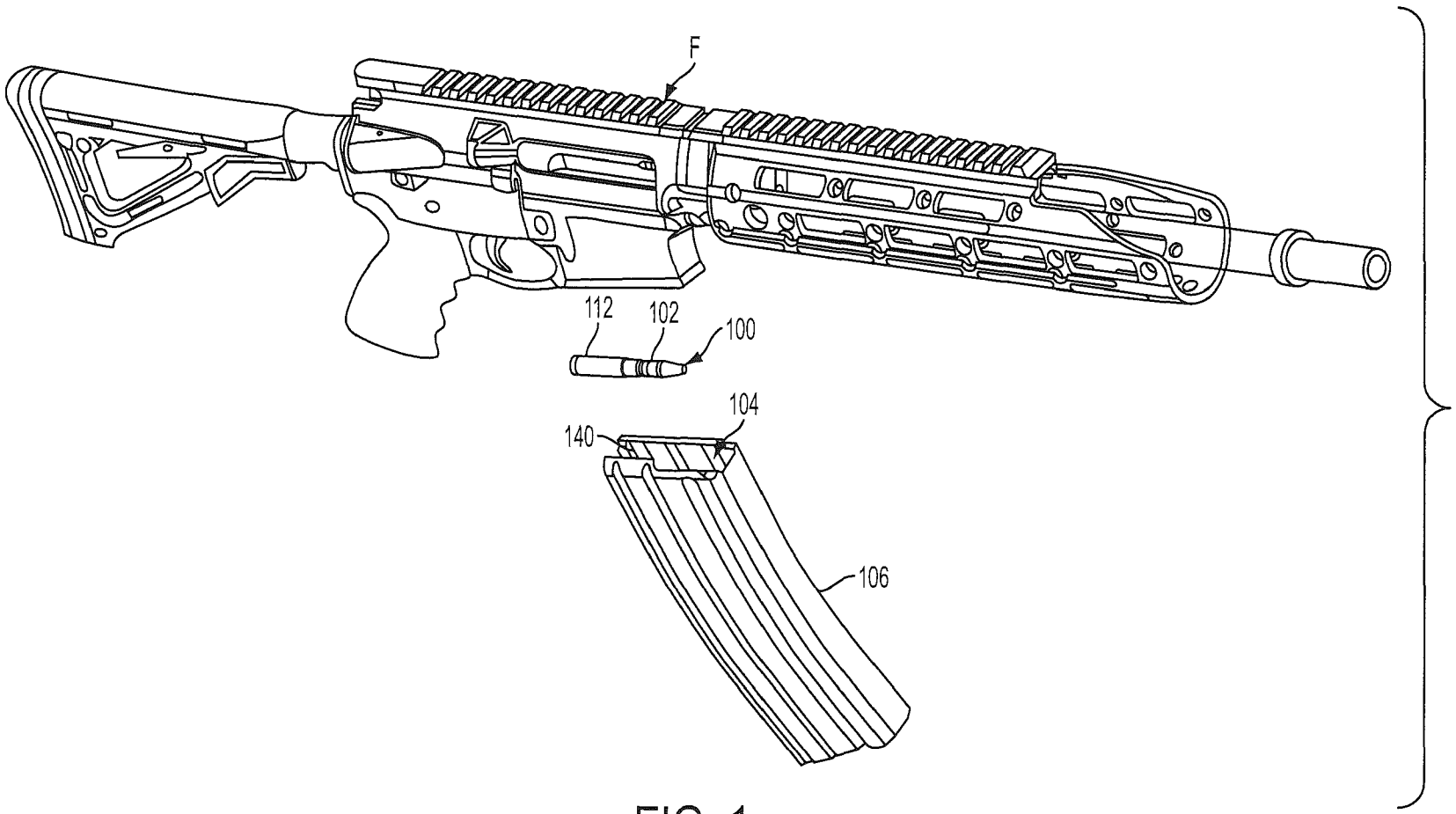
FIG. 1 is an exemplary illustration of a firearm with an exploded view of a cartridge and an ammunition magazine according to an embodiment of the invention.

The embodiments of the invention and the various features thereof are explained in detail with reference to the non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

It is understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this invention belongs. Preferred methods, devices, and materials are described, although any methods and materials similar or equivalent to those described herein can be used in the practice or testing of the invention.

FIGS. 1-9 generally illustrate various aspects and example embodiments of the invention, which is generally directed to a substantially cylindrical bullet (shown at 100 in FIGS. 2A-2B) with a circumferential guidance feature 102 configured to receive and engage a ribbed feature 104 of an ammunition magazine 106. The guidance feature 102 is adapted to receive the magazine rib 104, with the bullet 100 being located and guided by its engagement with the rib 104 to facilitate its smooth, consistent feeding therefrom, to prevent binding and allow for and maintain consistent proper alignment of the bullet as it moves along the magazine. FIGS. 1 and 5A-6 show examples of ammunition magazines 106 suitable to house a cartridge casing 108 engaged with bullet 100. For example, the ammunition magazine 106 may be a common 5.56 mm M4/AR-platform magazine having a rib designed to rest on the case neck of standard 223 and 5.56 mm ammunition. FIG. 1 shows an example of a firearm, here shown as an M4/AR style rifle 110 suitable to accept such ammunition magazine 106, with an example cartridge 112 shown exploded from the ammunition magazine 106. Other types of firearms using similar types of magazine including other long guns and hand guns also can be used with the projectiles formed according to the principles of the present invention.

Figure 2A:
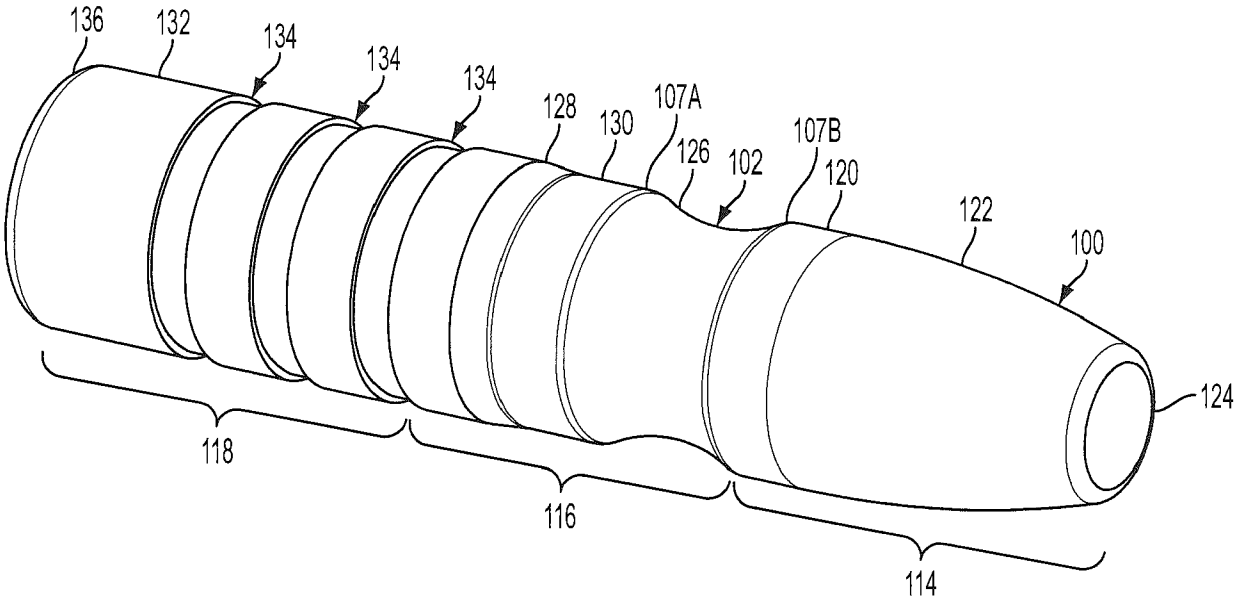
FIGS. 2A and 2B are exemplary illustrations of a bullet according to an embodiment of the invention.
Figure 2B:
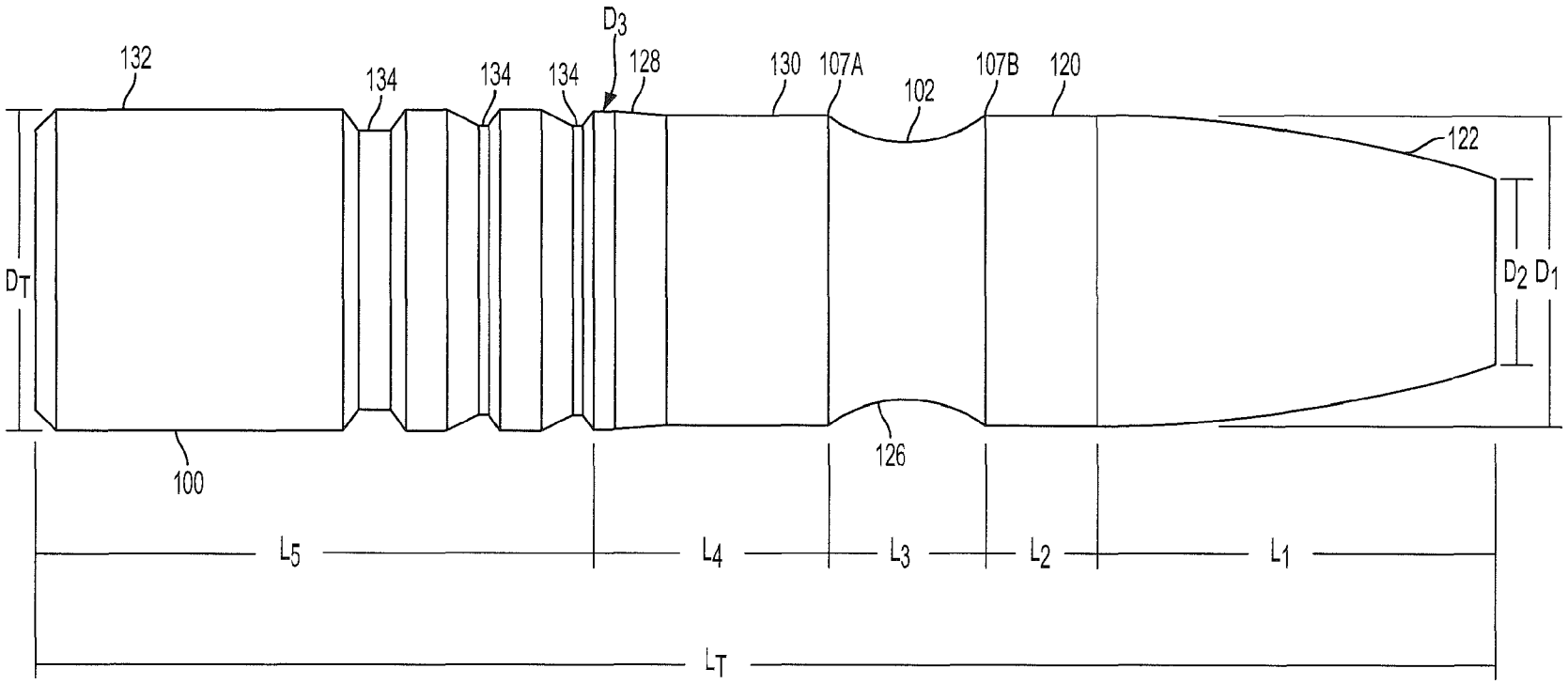
Figure 3:
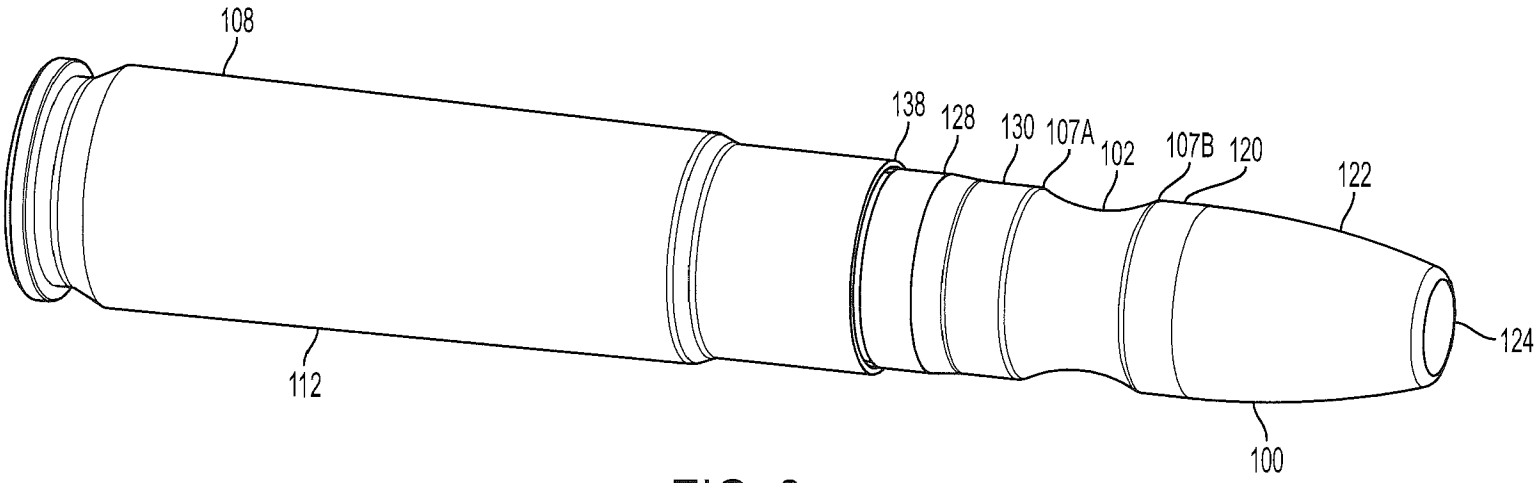
FIG. 3 is an exemplary illustration of a cartridge including a bullet as shown in FIGS. 2A and 2B, received within a casing.
Figure 4:
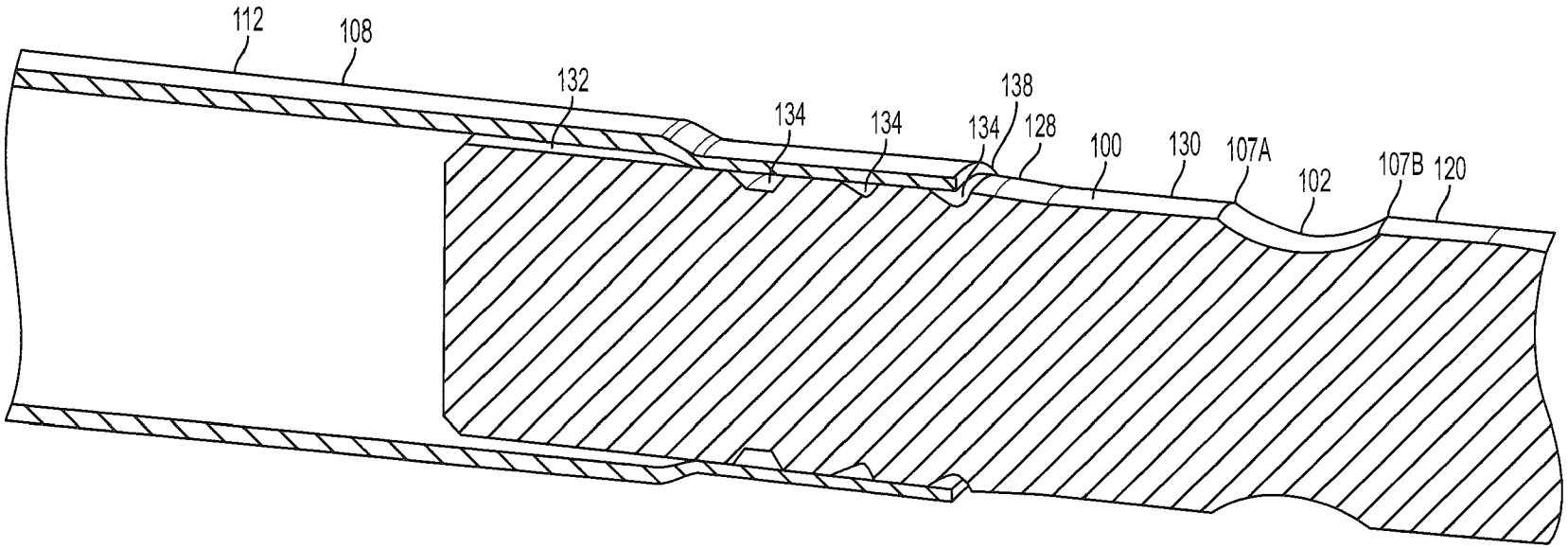
FIG. 4 is a cross-sectional view of the cartridge of FIG. 3 engaged with the bullet of FIG. 2A.

FIGS. 3-4 show one example embodiment of a cartridge or round of ammunition 112 using the bullet 100 shown in FIGS. 2A-2B. The round of ammunition 112 (e.g., a cartridge) for use in a firearm 110 may be produced using the bullet 100, which can be configured and produced according to the various embodiments of the invention disclosed herein. The bullet 100 may be combined with an appropriate casing 108, propellant change and primer, for example, to produce the cartridge or round of ammunition 112.

In one example embodiment, the bullet 100 may be constructed from various suitable cast metal materials, which could include but are not limited to metals, such as lead, mild steels, or copper and/or could also include composites or metal alloy materials. Typically, as indicated in FIGS. 2A-2B and 4, the bullet can be cast or molded from a single material. However, the bullet 100 further may comprise a jacket or plating surrounding the cast or molded bullet. For example, a jacket comprising a metal (copper) jacket or a jacket made from other suitable material could be applied after forming a core using an initial casting process, such as by casting the core or using a secondary mold to apply the jacket in a close fitted/tolerance configuration about the cast bullet core. The material used in the jacket does not have to match the material used in the bullet. Furthermore, the bullet 100 may be thinly coated/plated with copper or another suitable metal through electro-plating or other similar plating process.

As illustrated in FIGS. 2A-2B, the bullet 100 includes a first or front section 114, a second or middle section 116, and a third, rear or back section 118. The front section 114 comprises a front proximal portion 120, an ogive portion 122 and is shown with a meplat 124 defining the tip or distal end thereof. The front proximal portion 120 connects and transitions the middle section 116 to the ogive 122. The length L2 of the front proximal portion 120 may range from about 0.0 mm-4.0 mm or 0%-10% of the total bullet length LT. Further, the diameter of the front proximal portion 120 is shown designated as D1 along its entire length. This diameter D1 generally can range between approximately 50-80% of the total bullet diameter DT (FIG. 2B), and possibly greater, i.e., up to about 90% of total bullet diameter DT depending on bullet caliber or size. For example, in one embodiment, for a 300 AAC Blackout cartridge, the diameter D1 of the front proximal portion 120 can be approximately 0.253", about the diameter of a 5.56 mm case neck, while the total bullet diameter DT will be about 0.308", such that the front proximal portion diameter D1 for such a bullet can be about 80-82% of its total bullet diameter DT.

In one embodiment, the meplat 124 will have an expanded width/diameter D2, for example, ranging from about 3.0 mm-10.0 mm or about 45%-80% of the total diameter DT of the bullet 100. The diameter of the meplat further can be smaller or greater as needed or desired and/or depending on the caliber and/or configuration of the bullet. Enabling use of an expanded or larger meplat generally facilitates the provision of shifting or enabling placement of more of the bullet's weight in the forward half of the bullet, in front of the guidance feature 102, which in turn enables the center of mass of the bullet to be moved forwardly of the center of pressure thereof. As a result of shifting the center of mass of the bullet forwardly or otherwise front-loading the bullet weight in the front portion or half of the bullet forward of the guidance feature 102, i.e., within/along the ogive 122 and generally the front proximal portion 120 of the bullet, the bullet potentially can be made more terminally stable compared to bullets having significantly more weight in the rear half of the bullet, wherein the heavier rear portion of the bullet often tends to overtake the front end thereof during flight and upon impact. As a further result, the enlarged meplat 124 of the bullet also can aid in producing a deeper and straighter penetration channel than a bullet with a substantially smaller or no meplat.

The bullet 100 can be cast or otherwise machined so as to form the bullet with the ogive portion and meplat having varying diameters or widths, depending on bullet caliber or size, to provide for a larger mass or proportion of the total bullet weight to be formed or otherwise provided forward of the guidance feature 102 in an amount sufficient to shift the center of mass of the bullet forwardly of its center of pressure. The percentage of the bullet weight provided forwardly of the guidance feature 102 thus can be varied as needed for different caliber bullets to provide the desired forwardly projected weight distribution along the bullet body to obtain the desired increased terminal stability of the bullet in flight, while still enabling efficient, substantially smooth guidance and feeding of a cartridge including the bullet with guidance feature 102 along a magazine.

Further, forming the bullet 100 with a substantially flat, expanded meplat as shown in FIGS. 2A-2B can enable the bullet to be made with a shorter length for any given weight than a similar weight and/or caliber bullet with a pointed front end which in turn can allow for more case capacity of propellant. Within length limitations, due to case capacity and stability, a bullet with flat meplat also generally will be heavier for a given bullet length compared to a bullet having a pointed front end. A flat meplat also is known to have improved terminal effects such as more penetration than a similarly sized bullet with a pointed front end.

As illustrated in FIGS. 2A and 2B, the ogive 122 generally reduces in diameter from the front proximal portion D1 to the meplat diameter D2 and terminates adjacent or at the meplat 124. The diameter of the proximal end of the ogive can be substantially the same diameter, D2, as the meplat portion 124. The diameter of the distal end of ogive 122 can be substantially the same diameter, D1, as the front proximal portion 120. The ogive 122 may have an overall length L1 ranging from about 8.0 mm-12.5 mm or 25% to 35% of the total bullet length LT. Other, greater or lesser lengths of the ogive also can be used.

In one embodiment, the middle section 116 of the bullet comprises a substantially cylindrical body 126 in which the circumferential guidance feature 102 is formed, generally extending circumferentially around the bullet 100 at or adjacent a proximal end thereof and being located adjacent the front proximal portion 120. As illustrated in FIG. 2B, the middle 116 also can include a reduction feature 128 distal to the circumferential guidance feature 102, and a distal portion 130 having a length L4 that may range from about 0.0 mm-9.0 mm or about 0%-25% of the total bullet length LT. Further, the diameter of the distal portion 130, shown designated as D1, can be approximately equivalent to or slightly less than the overall bullet diameter DT along its entire length. The middle section 116 may be otherwise shaped, arranged, configured and/or omitted without departing from the disclosure.

Figure 5A:
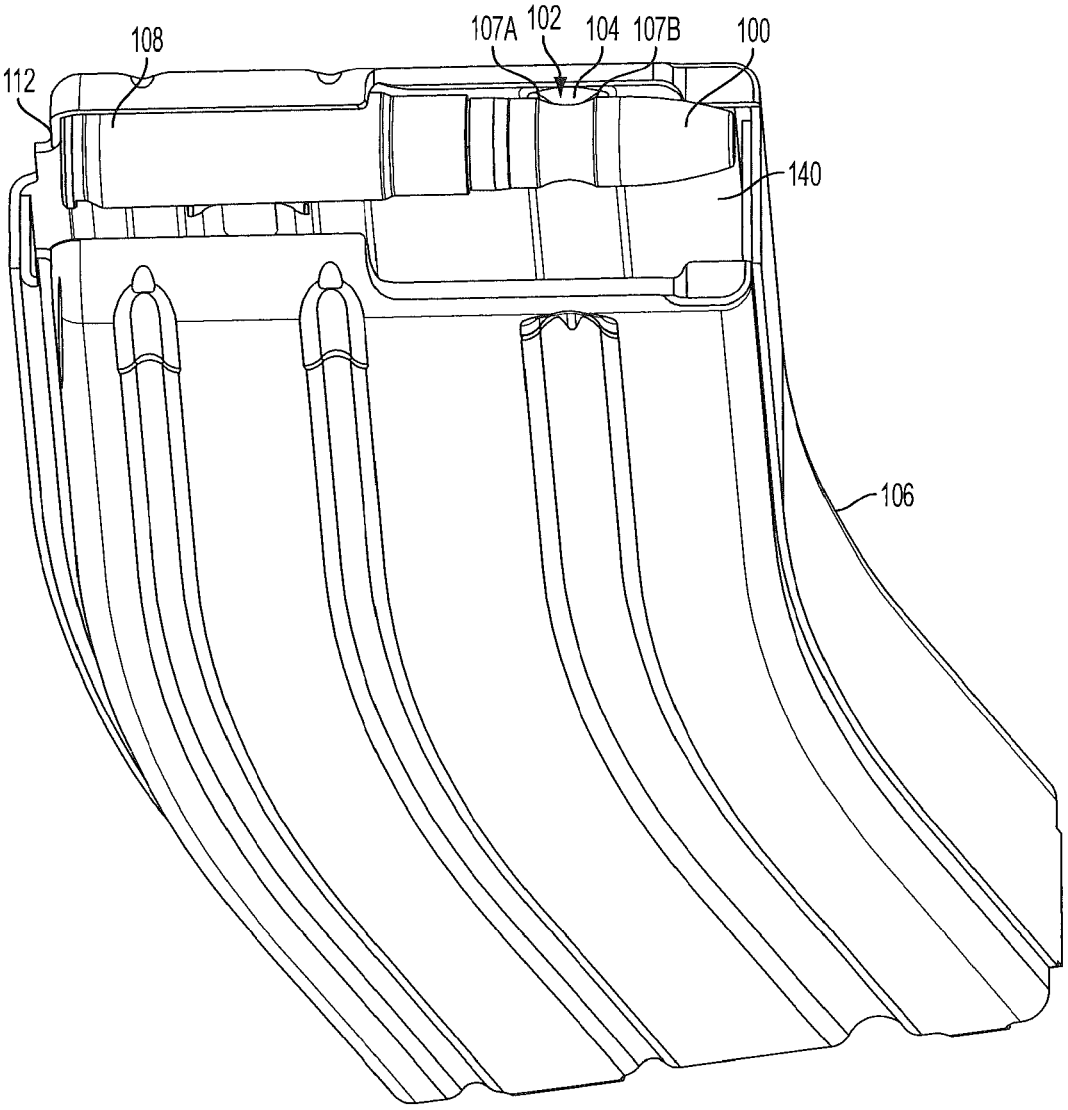
FIG. 5A is a perspective illustration showing an ammunition magazine with ribbed portions.
Figure 5B:
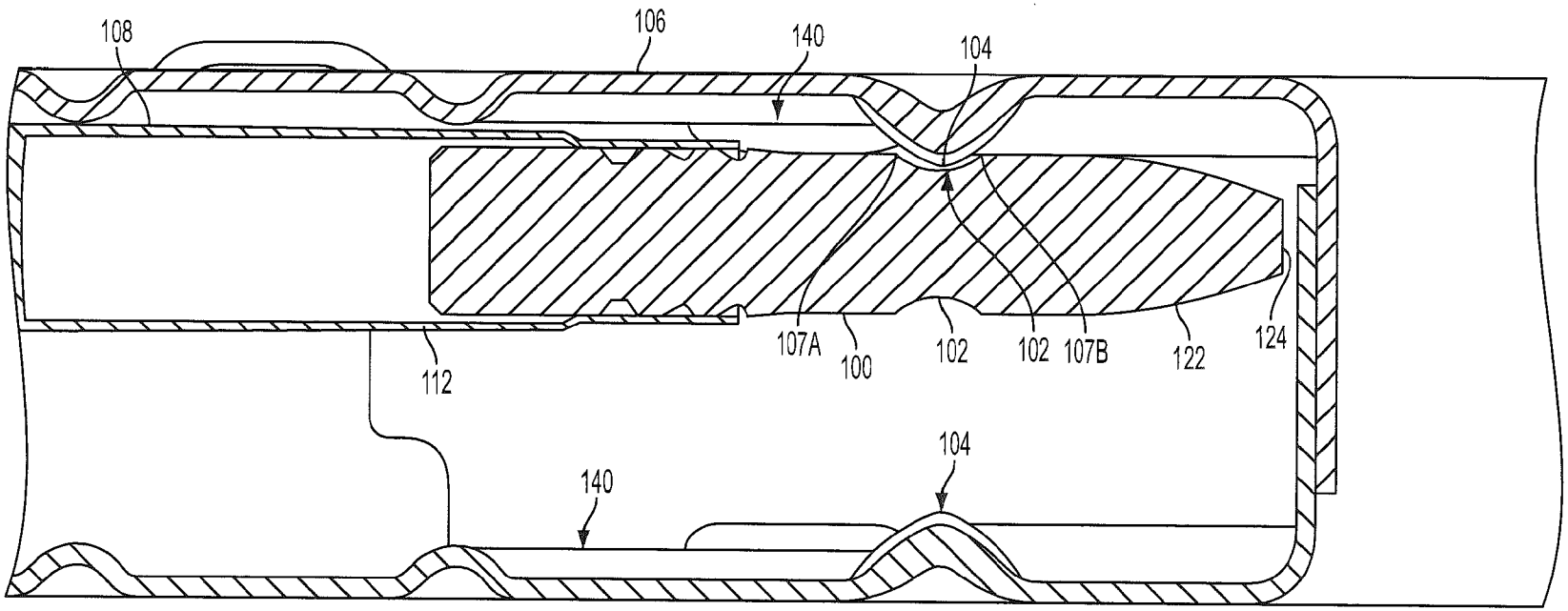
FIG. 5B is a cross sectional view of the ammunition magazine of FIG. 5A loaded with a cartridge as shown in FIG. 3.

In one embodiment, the circumferential guidance feature 102 may be formed as a generally concaved, arcuate, or hour-glassed shape indentation 103 defined between forward and aft shoulder portions 107A/107B (FIG. 2B) that substantially conforms to the shape of the male rib 104 of the ammunition magazine 106, as shown in FIGS. 5A-5B. The indentation 103 of circumferential guidance feature may have a diameter that is smaller than the diameter of the front proximal portion and the middle portion of the bullet. The circumferential guidance feature 102 will be configured to receive and engage the rib 104 of the ammunition magazine 106, with a slight clearance provided therebetween to substantially retard or prevent the cartridges from tilting or being urged inwardly which can cause binding as the cartridges are advanced inside the ammunition magazine. As a result, the circumferential guidance feature 102 retards lateral movement of the cartridges and maintains normal alignment when the cartridges 112 are engaged with the rib 104 during feeding or advancement of the cartridges along the magazine. The length L3 (shown in FIG. 2B) of the circumferential guidance feature 102 may range from about 5%-25% of the total bullet length LT. The circumferential guidance feature 102 may be otherwise shaped, arranged, or configured without departing from the disclosure. For example, the circumferential guidance feature 102 may be square, elliptical, or V-shaped without departing from the disclosure.

In one embodiment, the back section 118 is rearward of the reduction feature 128. The back section 118 generally comprises a shank or distal portion 132, and can be provided with one or more circumferential grooves or cannelures 134 positioned therealong. For example, three cannelures 134 are shown along distal portion 132 in FIGS. 2A-2B. The distal portion 132 has a diameter DT, the largest diameter of the bullet 100, shown in FIG. 2B. The length L5 of the back section 118 may range from about 30%-45% of the total bullet length LT, although greater or lesser lengths also can be used. As illustrated in FIG. 2A, the distal portion 132 has a base 136 which can be flat or tapered. A flat base 136 can provide more weight and possibly greater penetration, while a tapered base (shown in FIG. 2A) can provide greater accuracy over distance.

As illustrated in FIG. 4, the cannelures 134 are circumferential grooves around the bullet 100 that may be used for identification and for sealing the bullet 100 inside the casing 108. The cannelures 134 provide a more secure, accurate and efficient way of attaching the casing 108 to the bullet 100. The cannelures 134 may be used, for example, as a guide during crimping of a casing 108 to a bullet 100 and/or for retaining a lubricant. The cannelures 134 may be otherwise shaped, arranged, configured and/or omitted, and greater or lesser numbers of cannelures can be used without departing from the disclosure.

FIGS. 3-4 illustrate an assembled centerfire cartridge or round of ammunition 112 including a bullet 100. The widest point of the outside diameter D3 of the reduction portion 128 can be located at approximately the mouth 138 of the cartridge casing 108, with the wider diameter base end of the bullet engaging the walls of the casing to locate the bullet 100 at a desired position therealong. The length of the casing 108 may expose, partially cover, or fully cover the circumferential indentation 103 forming the guidance feature 102.

FIG. 2B further shows a finished/contoured profile of the bullet 100 wherein the widest diameter of the bullet reduction portion 128 (designated at "D3" by arrows) is smaller than the diameter of the shank 132 (i.e., the diameter DT of the base portion 118 thereof). It should be understood that in the illustrated profile, the shank 132 diameter is preferably at or approximately equivalent to the firearm barrel's "groove diameter" and the diameter of the reduction portion 128 at its greatest width is preferably at or about the firearm barrel's "bore diameter." This diameter arrangement can help provide an additional reduction in in-bore friction as the bullet moves along the barrel bore, resulting in still higher muzzle velocities. Additionally, the diameter of the front, proximal portion 120, distal portion 130, and the reduction portion 128, can be substantially the same diameter as the shank 132 if desired.

Figure 6:
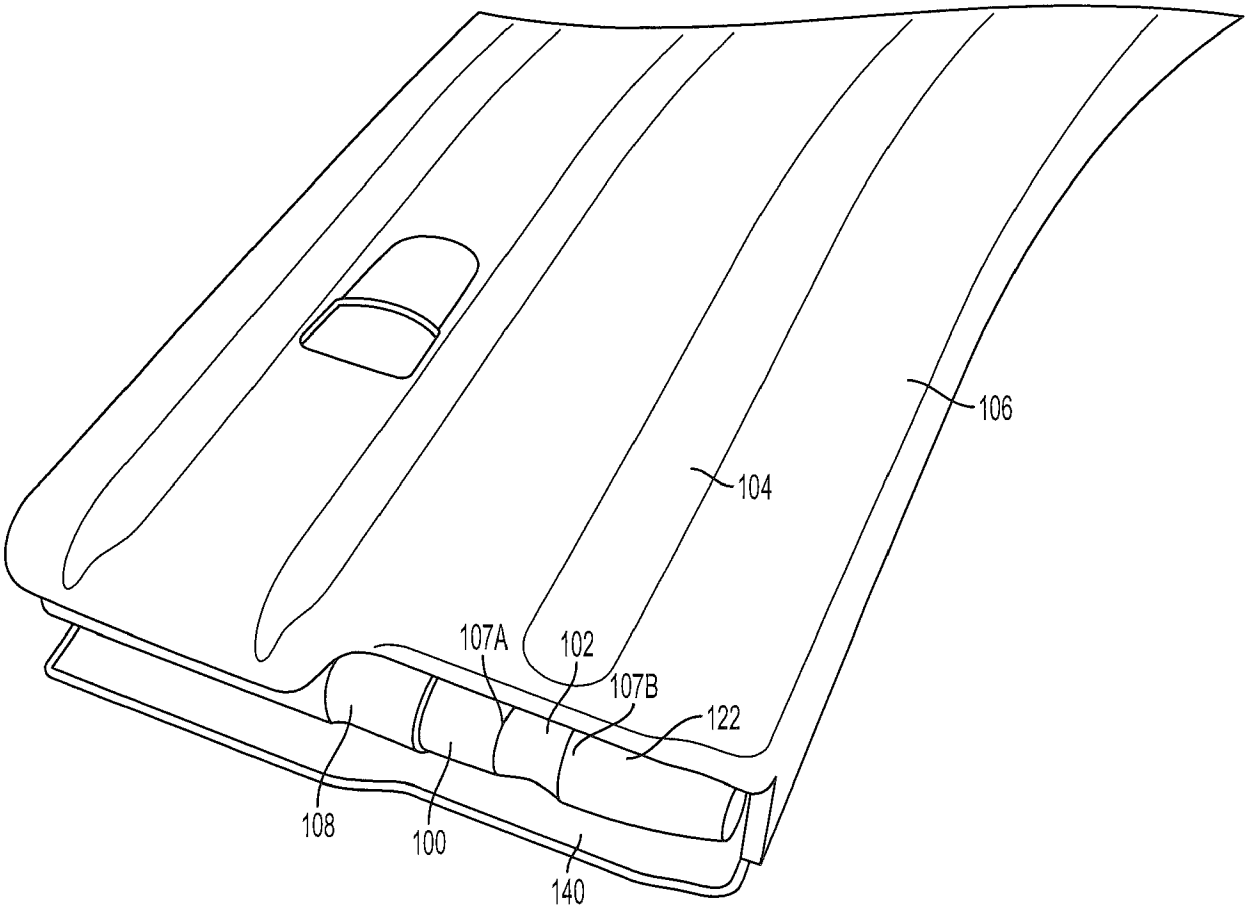
FIG. 6 is a perspective illustration of an ammunition magazine with ribbed portions loaded with a cartridge as shown in FIG. 3.

FIGS. 5A-6 illustrate various example embodiments of ammunition magazines 106 for holding and feeding the cartridges 112 into the chamber of a firearm. The ammunition magazines 106 comprise ribbed portions 104 in both walls 140. In one embodiment shown in FIGS. 5A-5B, the ammunition magazine can include a double stack magazine in which the cartridges can be arranged in staggered columns, while FIG. 6 shows a magazine with a single column arrangement of cartridges. Only one ribbed portion 104 can be provided to guide the bullets 100 in the magazines as needed or desired.

Figure 7A:
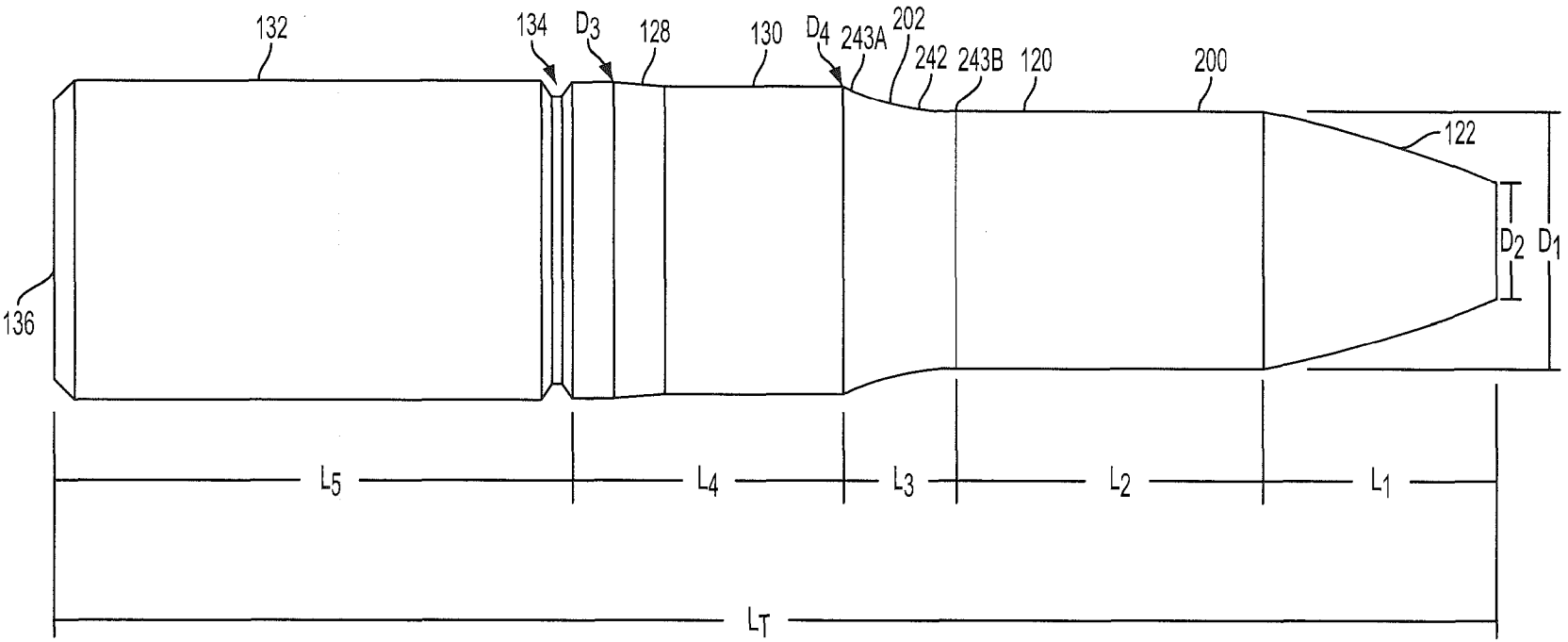
FIGS. 7A and 7B illustrate another embodiment of a bullet formed according to the principles of the present invention.
Figure 7B:
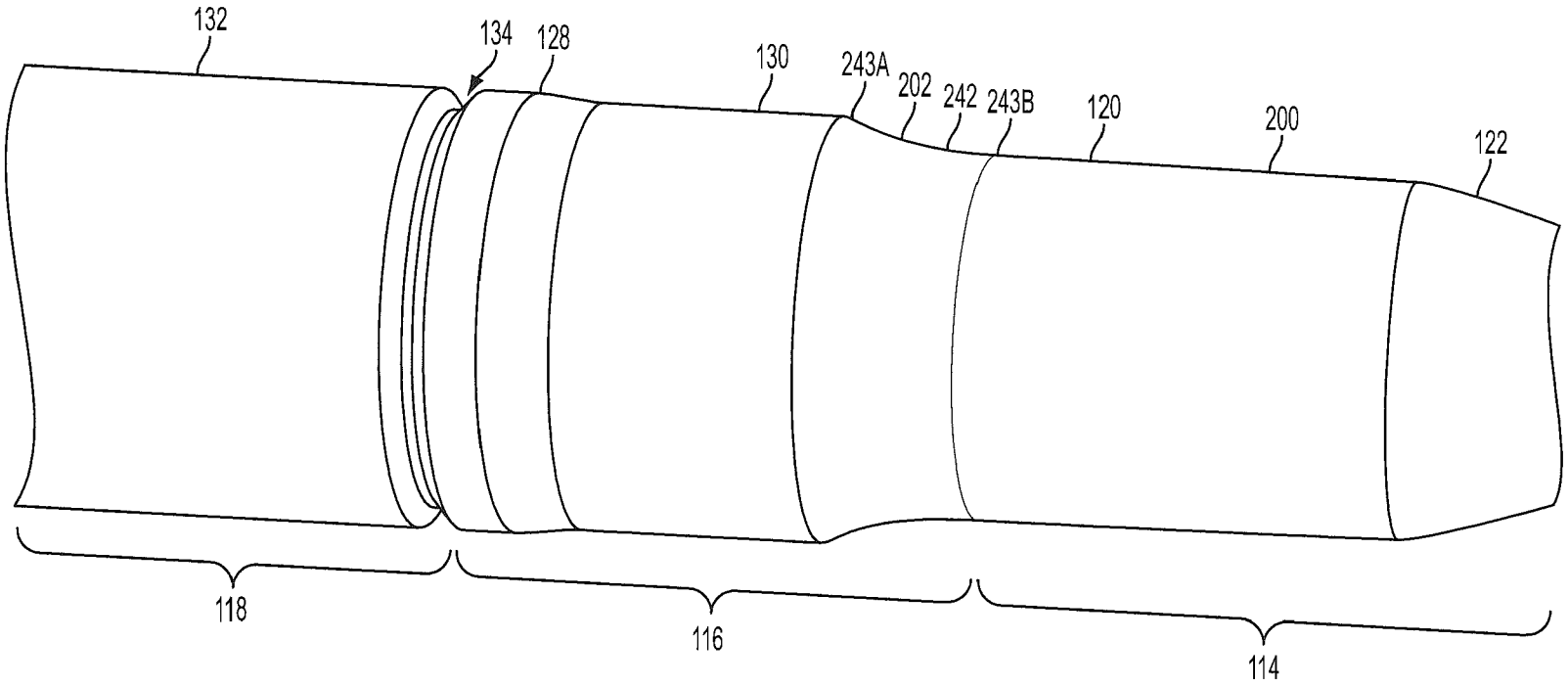

FIGS. 7A-7B illustrate yet another embodiment of a bullet 200 with a circumferential guidance feature 102. The bullet 200 shown in FIGS. 7A-7B has a smaller meplat 124 and may not be as heavy for a given bullet length as the bullet 100 shown in FIGS. 2A-4. Therefore, bullet 200 may exhibit a different or lesser terminal performance compared to bullet 100. However, the bullet 200 shown in FIGS. 7A-7B can be manufactured by a wider range of methods such as high-speed swaging on conventional bullet-making equipment, in addition to methods such as casting, molding or extrusion processes.

As indicated in the Figures, similar or identical features of the embodiments are provided with like reference numbers. For example, as shown in FIGS. 7A-7B, the bullet 200 comprises a front section 114, middle section 116, and back section 118.

In the present embodiment, the front section 114 of the bullet 200 (FIG. 7A) can likewise comprise a front proximal portion 120, an ogive portion 122, and a meplat 124. The length of the front proximal portion 120 may range from about 0.0 mm-9.0 mm or 0%-25% of the total bullet length LT, with the ogive portion 122 having a length L1 that may range from about 4.0 mm-7.0 mm or approximately 10%-20% of the total bullet length LT. The diameter of the front proximal portion 120 is shown designated as D1 in FIG. 7A along its entire length and may range from about 5.5 mm-7.9 mm or approximately 70%-100% of a total bullet diameter DT. The meplat 124 has a width/diameter D2 generally that can range from about 2.5 mm-3.5 mm or approximately 30%-45% of the total bullet length LT. The ogive 122 transitions the diameter generally from the diameter D1 of front proximal portion 120 to the meplat diameter D2.

In addition, the middle section 116 can comprise a circumferential guidance feature 202 that extends circumferentially around the bullet 200 and terminates adjacent the front proximal portion 120 of the bullet. The length L4 of the middle section 116 may range from about 3.0 mm-8.0 mm or 10%-25% of the total bullet length LT, and the diameter of the middle section 116, shown designated as D4, may range from about 6.0 mm-8.0 mm or approximately 75%-100% of the total bullet width DT along its entire length. The middle section 116 also may be otherwise shaped, arranged, configured and/or omitted without departing from the disclosure.

As shown in FIGS. 7A-7B, the middle section 116 also can include reduction feature 128 wherein the bullet is reduced in diameter, with the diameter D3 being slightly less than the overall diameter DT of the bullet, for example, generally ranging from about 0.05% to 3% of the overall diameter DT of the bullet 200. However, the diameter D3 may be substantially the same diameter as the overall bullet diameter DT.

Figure 8:
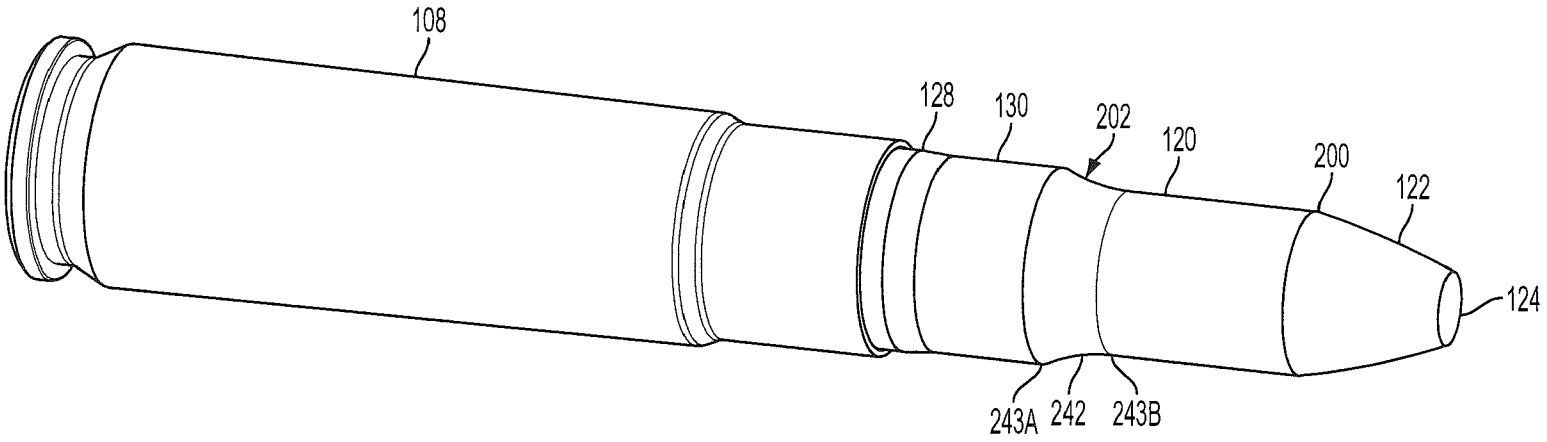
FIG. 8 is a perspective view of a cartridge including the bullet of FIGS. 7A-7B loaded within a casing.
Figure 9:
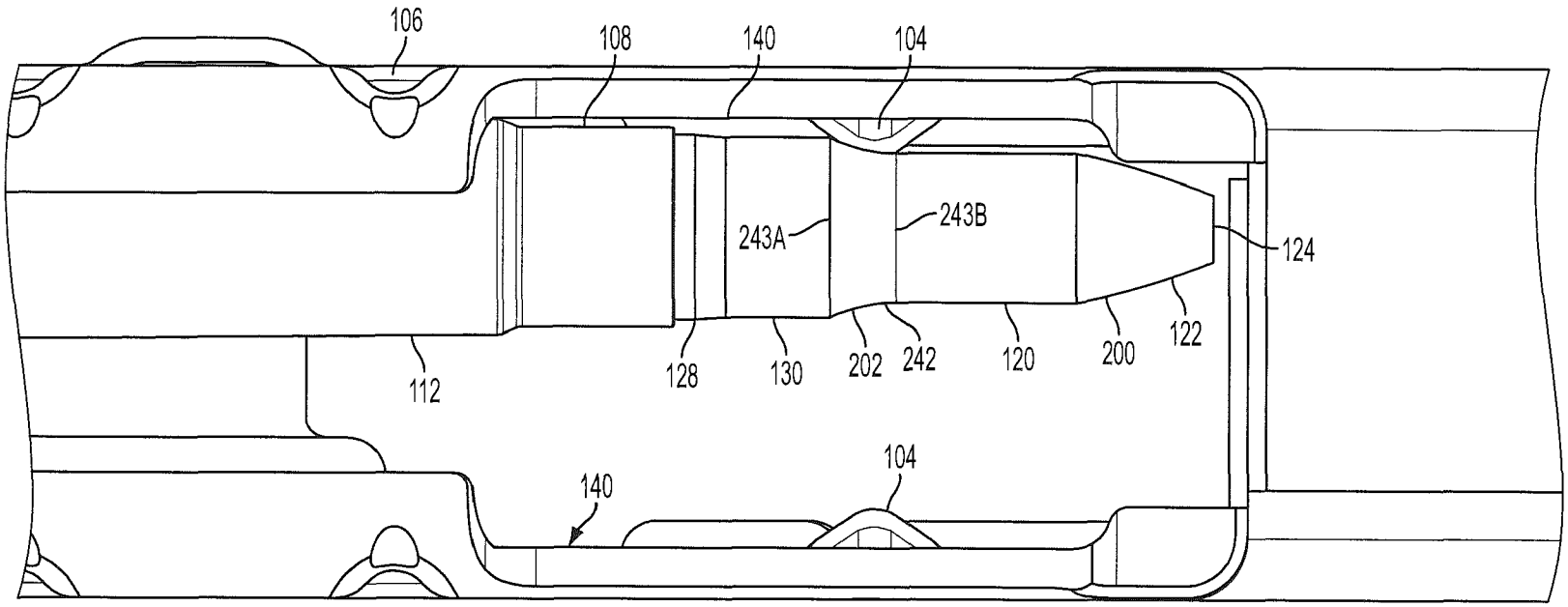
FIG. 9 is a plan view illustrating a staggered ammunition magazine comprising ribbed portions, loaded with a cartridge shown in FIG. 8.

In another embodiment, as shown in FIGS. 8-9, the circumferential guidance feature 202 may have a generally inwardly curved or tapering shape that substantially reduces the diameter of the bullet from D4 (FIG. 7A) of the middle portion 116 to D1 of the front proximal portion 120, a curved portion 242 configured to engage the male rib 104 (FIG. 9) of an ammunition magazine 106. The circumferential guidance feature 202 is configured to receive and engage the rib 104 of the ammunition magazine 106 to prevent the cartridges from tilting inward and cause binding as the cartridges advance inside the ammunition magazine. Further, the circumferential guidance feature 202 prevents lateral movement of the cartridges 112 in the forward direction. The circumferential guidance feature 202 may be otherwise shaped, arranged, or configured without departing from the disclosure. For example, the circumferential guidance feature 202 may have a right angle or exponentially curved without departing from the disclosure.

As illustrated in FIGS. 7A-8, the bullet 200 also will include a back section 118 that is rearward of the reduction feature 128. The back section 118 comprises a shank or distal portion 132 with a circumferential groove or cannelure 134 positioned adjacent the reduction portion 128 of the middle section 116. The cannelure 134 may be otherwise shaped, arranged, configured and/or omitted without departing from the disclosure. The distal portion 132 has a diameter DT, the largest diameter of the bullet. Further, the distal portion 132 has a base 136 which can be flat or tapered.

Figure 10:
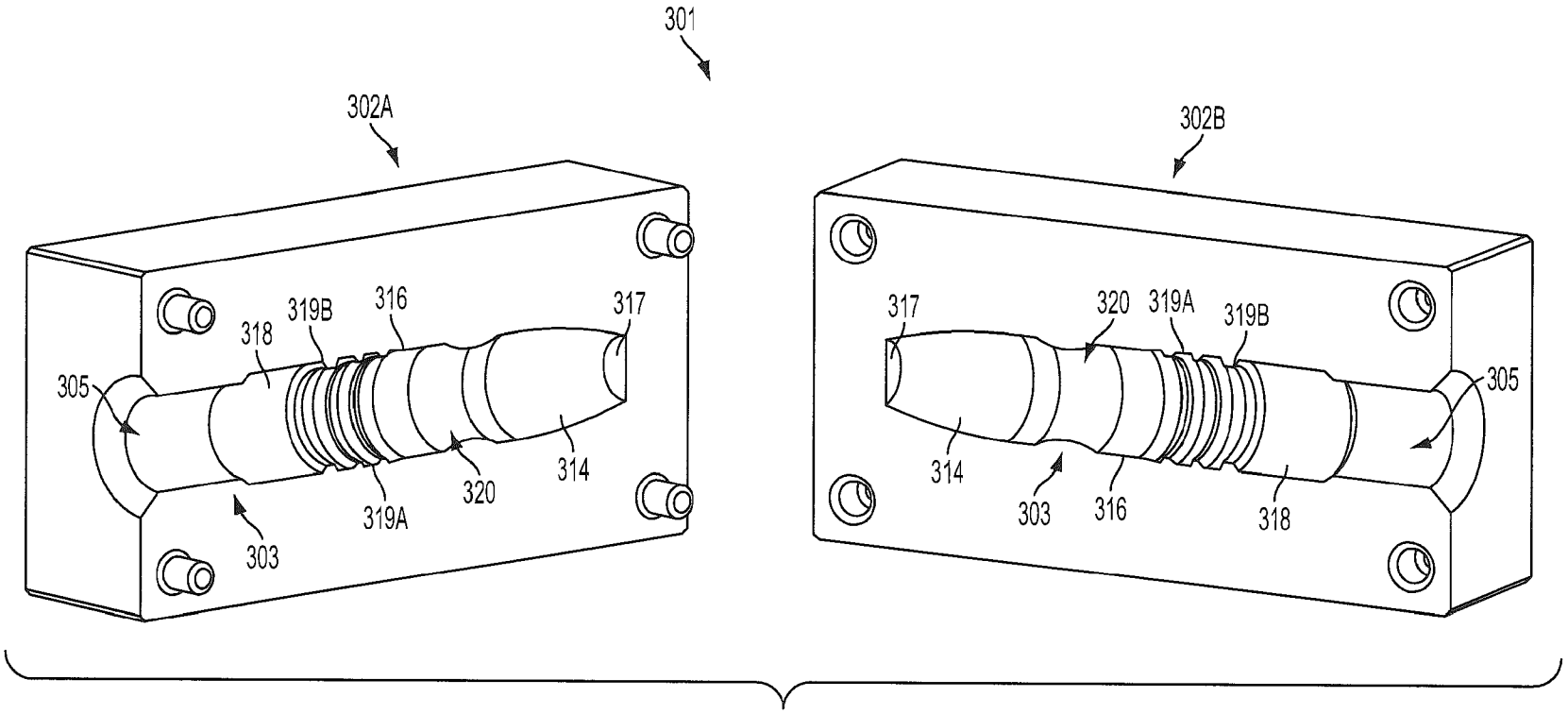
FIG. 10 is a perspective view of one example embodiment of a mold for casting a bullet.
Figure 11A:
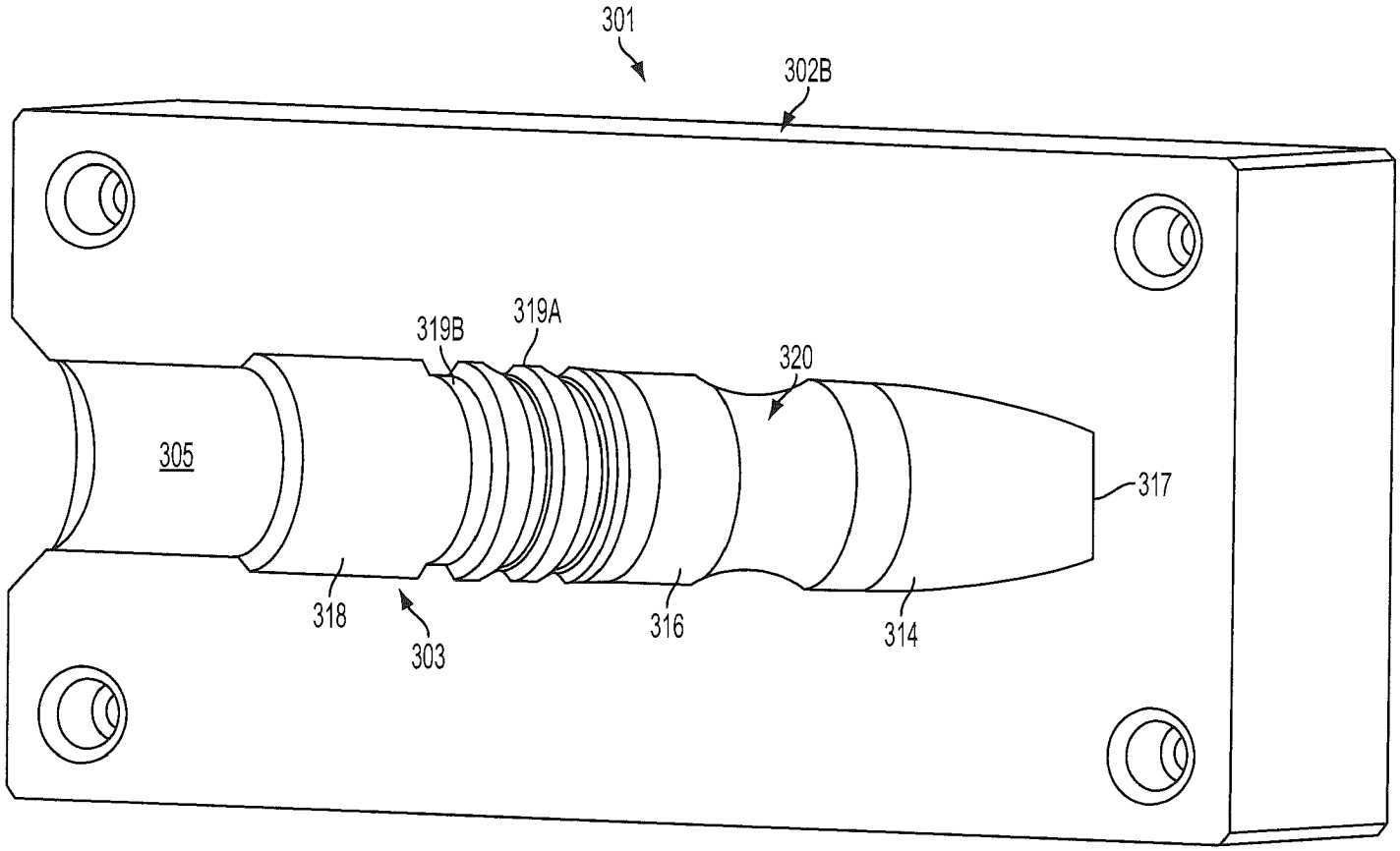
FIGS. 11A and 11B are perspective views illustrating inner and outer side surfaces of the mold of FIG. 10.
Figure 11B:
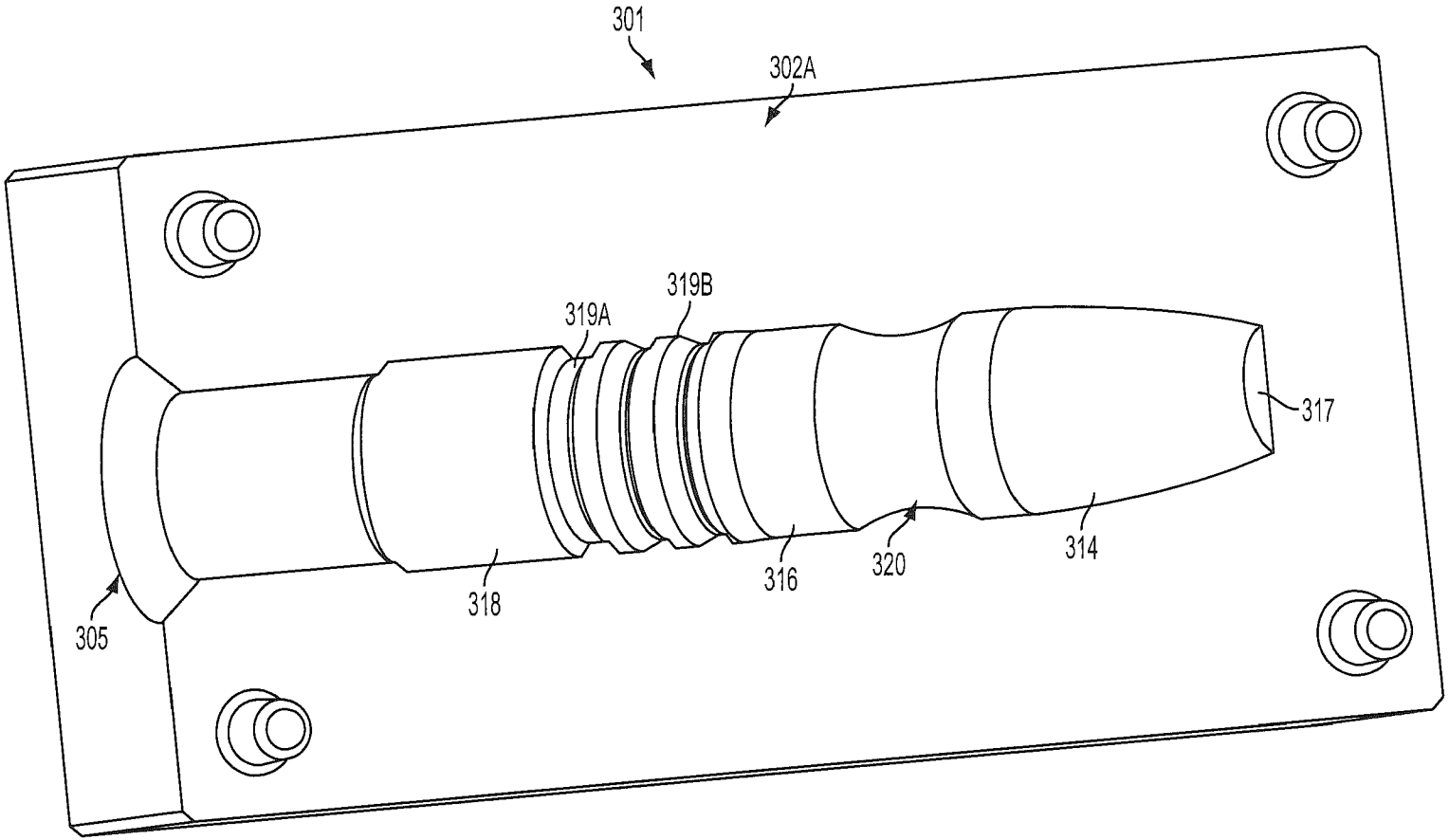

One exemplary method of forming bullets 100, 200 in accordance with the principles of the present invention includes casting the bullet using a mold 301 such as shown in FIGS. 10-11B. As illustrated in FIGS. 10-11B, in one embodiment, the mold 301 can comprise two or more rigid body sections 302A/302B, each formed from a high strength, high temperature resistant material, and each including complementary hollowed out spaces 303 in the shape of either bullet 100, 200, including the guidance features to be formed therein. The mold 301 may be hinged and when its sections 302A/302B are closed together, the hollowed out spaces 303 are brought into registration to fat it the shape of the bullet, as indicated in FIG. 11B. In one embodiment, the bullet is cast by pouring molten metal into the bullet shaped cavities or spaces of the mold, such as via port or opening 305. After the metal is cooled, the mold is opened and the bullet(s) can fall out or otherwise be removed, after which any imperfections in the bullets also can then be removed.

In addition, while a single bullet cavity is shown, the mold 301 also may comprise multiple spaces or cavities for forming a number or different bullets at a time. As FIGS. 10-11A illustrate, in one embodiment, the spaces 303 of the mold 301, are similar to the counterpart bullets formed therein, and may have a first section 314, a second section 316, and third section 318. The first section can comprise a cavity for the front proximal portion and ogive configuration of the bullet, and can terminate at a distal end that can be pointed, curved, flat, or configured to form meplat at the end of the bullet, as indicated at 317. The first section 314 also may be otherwise shaped, arranged, and/or configured without departing from the disclosure.

As shown in FIGS. 10-11A, the second section 316 of the mold 301 may comprise an inwardly extending projection 320. This projection can have a convex shape or be otherwise configured to form the guidance feature of a sufficient depth to receive and locate the bullet along a rib of the ammunition magazine. The cavity also can include a reduction feature portion that defines the transition between the second section 316 and the third section 318 of each space 303. The second section 316 may be otherwise shaped, arranged, and/or configured without departing from the disclosure.

The third section 318 of the mold 301 can be configured to form the distal portion of the bullet. The third section 318 can include one or more protrusions and/or recesses 319A/319B configured to form circumferential grooves or cannelures in the bullet as desired, and will terminate at a proximal end configured to form the base at the end of the bullet. The mold 301 may be configured to form a flat or tapered base. The third section 318 may be otherwise shaped, arranged, and/or configured without departing from the disclosure.

It should be understood that, regardless of its intended use or the firearm from which it is fired, the bullet as disclosed herein may have any forward profile or any nose type. Any forward profile or nose type can be used. The front portion of the bullet can be ogival, conical, frusto-conical, spherical or cylindrical (the latter terminating in a flat at the nose). By the same token, the rear profile of the bullet can be of any shape desired. The rear profile does not have to be flat as shown in the illustrations herein. As an alternative, the base of the bullet may terminate in a "boat tail" shape if desired.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A bullet configured to be fed from an ammunition magazine of an M4 or AR-15, the bullet comprising:

a bullet body comprising a first section, a second section, and a third section;

the first section of the body comprising an ogive portion, a front proximal portion defining a transition between the first and second sections, and terminating in a meplat; and the second section of the body comprising a guidance feature adjacent the frontal proximal portion defining a transition between the first and second sections, and configured to receive and locate the bullet body along a rib of the ammunition magazine so as to maintain alignment of the bullet as it is fed along the ammunition magazine, wherein a clearance is defined between the rib of the ammunition magazine and guidance feature sufficient to retard binding of the bullet as it is moved along the rib of the ammunition magazine.

2. The bullet of claim 1, wherein the third section comprises a distal portion and at least one cannelure positioned along the distal portion.

3. The bullet of claim 2, wherein the second section of the body further comprises a reducing feature and a middle portion; and wherein the guidance feature extends circumferentially around the bullet between the middle portion of the second section and the front proximal portion of the first section.

4. The bullet of claim 3, wherein the front proximal portion of the first section of the body has a first diameter, the middle portion of the second section of the body has a second diameter and the guidance feature comprises an inwardly curved depression having a third diameter that is smaller than the first diameter and the second diameter.

5. The bullet of claim 1, wherein the guidance feature comprises a concave shape that extends inwardly and circumferentially around the bullet.

6. The bullet of claim 1, wherein the guidance feature comprises an arcuate indentation that engages the rib of the ammunition magazine and restricts lateral movement of the bullet when the circumferential guidance feature is engaged with the rib of the ammunition magazine.

7. The bullet of claim 1, wherein a diameter of the bullet body is between approximately 3 mm and approximately 8 mm.

8. The bullet of claim 1, wherein a diameter of the front proximal portion is between approximately 50% and approximately 90% of a total diameter of the bullet body.

9. The bullet of claim 1, wherein a length of the guidance feature along the bullet body is approximately 5% to approximately 25% of a total length of the bullet body.

10. The bullet of claim 1, wherein the bullet is configured to be a component of a 300 ACC Blackout cartridge.

11. A bullet adapted to be fed from an ammunition magazine, the bullet comprising:

a cast bullet body having a metal jacket surrounding a malleable core, the metal jacket comprising a first section, a second section, and a third section, the first section of the body comprising an ogive portion, a front proximal portion defining a transition between the first and second sections, and terminating in a front end of the bullet body; and the second section of the body comprising a guidance feature adjacent the frontal proximal portion defining a transition between the first and second sections, and configured to receive and locate the bullet body along a rib of the ammunition magazine so as to maintain alignment of the bullet as the bullet is fed along the ammunition magazine, wherein a clearance is defined between the rib of the ammunition magazine and the guidance feature of the body sufficient to retard binding of the bullet as the bullet moves along the ammunition magazine.

12. A bullet configured to be fed from an ammunition magazine, the bullet comprising:

an elongated body having a selected total length and comprising:

a first section comprising an ogive portion and terminating at a front end of the bullet;

a second section adjacent the first section, and comprising a guidance feature configured to receive and substantially locate the bullet along a rib of the ammunition magazine so as to maintain alignment of the bullet as the bullet is fed along the ammunition magazine, the guidance feature having a complementary profile with respect to the rib of the ammunition magazine that is shaped and dimensioned to substantially retard binding of the bullet as the bullet is fed along the ammunition magazine; and a third section located between the second section and a rear end of the bullet, wherein the guidance feature is located along the body of the bullet at a distance from the rear end of the bullet of between approximately 30% and approximately 70% of the selected total length of the body of the bullet.

13. The bullet of claim 12, wherein the guidance feature is further positioned along the bullet such that a distance between the guidance feature and the front end of the bullet is between approximately 25% to approximately 50% of the selected total length of the bullet of the body of the bullet.

14. The bullet according to claim 12, wherein a length of the guidance feature along the bullet is approximately 5% to approximately 25% of the total bullet length.

15. The bullet of claim 12, wherein the guidance feature comprises a substantially arcuate, concave, square, elliptical, V and/or hourglass shape that extends inwardly and circumferentially around the bullet.

16. A bullet configured for feeding from an ammunition magazine, the bullet comprising:

a first section comprising an ogive portion;

a second section located rearwardly from the first section and including a guidance feature formed along a portion thereof, the guidance feature configured and comprises a shape that substantially conforms to a rib of the ammunition magazine and is located so as to receive and substantially locate the bullet along the rib of the ammunition magazine so as to align and guide movement of the bullet for substantially consistent feeding of the bullet along the ammunition magazine such that binding of the bullet is substantially arrested; and a third section positioned rearward of the second section and terminating in a base of the bullet, wherein the guidance feature is positioned along the bullet such that a distance between the guidance feature and a front end of the bullet is between approximately 25% and approximately 50% of a selected total bullet length.

17. The bullet of claim 16, wherein the guidance feature is located along the bullet such that a distance between the guidance feature and the rear end of the bullet is between approximately 30% and approximately 70% of the selected total length of the bullet.

18. The bullet according to claim 16, wherein a length of the guidance feature along the bullet is approximately 5% to approximately 25% of the selected total bullet length.

19. The bullet of claim 16, wherein a diameter of the bullet body is between approximately 3 mm and approximately 8 mm.

20. The bullet of claim 16, wherein the first section of the bullet further comprises a substantially flat, expanded meplat defined at the front end of the bullet, the meplat enabling the bullet to be made with a shorter selected length for a prescribed weight and/or to have improved terminal effects.

* * * * *